US010589919B2

(12) United States Patent
Losco

(10) Patent No.: US 10,589,919 B2
(45) **Date of Patent: *Mar. 17, 2020**

(54) THERMALLY INSULATED TRANSPORT CONTAINER COMPRISING THERMAL INSULATION RESTING AGAINST THE WALLS, AND WALL STRUCTURE OF A CONTAINER OF SAID TYPE

(71) Applicant: THERMOSECURE MEDICAL EQUIPMENT GMBH, Köln (DE)

(72) Inventor: Dirk Losco, Leverkusen (DE)

(73) Assignee: Thermosecure Medical Equipment GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/519,645

(22) PCT Filed: Oct. 26, 2015

(86) PCT No.: PCT/EP2015/074707

§ 371 (c)(1),
(2) Date: Apr. 17, 2017

(87) PCT Pub. No.: WO2016/062894

PCT Pub. Date: Apr. 28, 2016

(65) Prior Publication Data

US 2017/0247169 A1 Aug. 31, 2017

(30) Foreign Application Priority Data

Oct. 24, 2014 (DE) ..... 10 2014 221 657
Aug. 19, 2015 (DE) ..... 10 2015 113 693

(51) Int. Cl.
*B65D 81/38* (2006.01)
*B65D 90/507* (2019.01)
(Continued)

(52) U.S. Cl.
CPC ..... *B65D 81/3823* (2013.01); *B65D 88/14* (2013.01); *B65D 88/74* (2013.01);
(Continued)

(58) Field of Classification Search
CPC .... B65D 81/38–3823; B65D 90/02–06; B65D 90/022; B65D 88/74; B65D 88/14; B65D 90/48–506
(Continued)

(56) References Cited

U.S. PATENT DOCUMENTS 3,895,152 A * 7/1975 Carlson ..... B65D 90/06 428/116
4,023,617 A * 5/1977 Carlson ..... B65D 90/06 156/79
(Continued)

FOREIGN PATENT DOCUMENTS

DE 69630193 T2 6/2004
WO 2005016643 A1 2/2005
WO 2012085212 A2 6/2012

OTHER PUBLICATIONS

PCT International Search Report and Written Opinion completed by the ISA/EP dated Dec. 10, 2015 and issued in connection with PCT/EP2015/074707.

*Primary Examiner* — Kareen K Thomas
(74) *Attorney, Agent, or Firm* — Barnes & Thornburg LLP

(57) ABSTRACT

The invention relates to a thermally insulated transport container with a housing for forming a space for goods, with walls and a thermal insulation abutting the walls as well as a wall structure of such a container. In particular, the invention relates to such a container as an air cargo container. According to the invention, sandwich plastic plates are provided as walls, with a honeycomb core welded on both sides to one covering ply, respectively, the honeycomb
(Continued)

Figure 1:
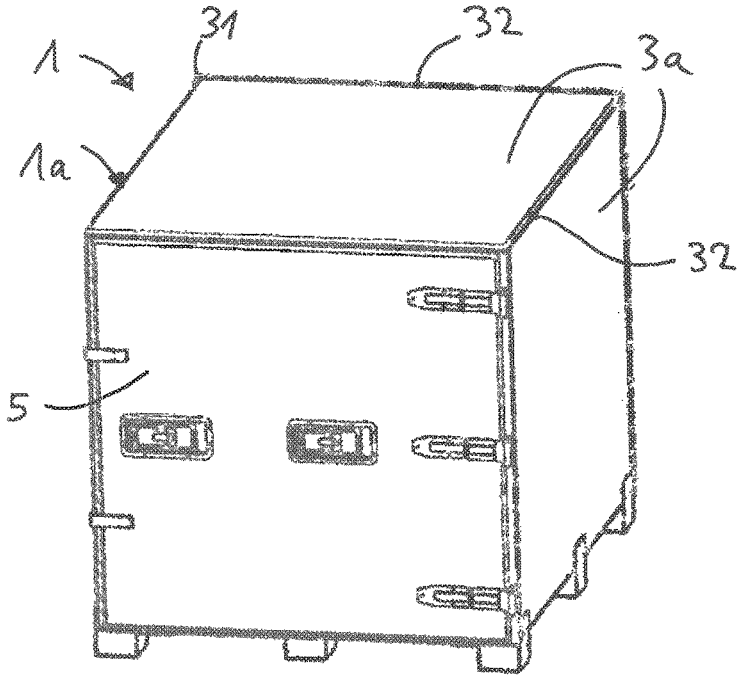

core and the covering plies consisting of a thermoplastic material, preferably PP. In this case, the walls are, in particular, a thermoplastic sandwich panel, consisting substantially of a PP (polypropylene) honeycomb core and PP covering layers, in particular glass-fiber reinforced, which are, with regard to the materials, homogenously connected to each other by thermally fused connection. Such plates are offered, for example, by Wihag Composites GmbH & Co. KG under the trademark MonoPan®, which are preferred in this case. The use of thermoplastic material makes it possible for adjacent sandwich plastic plates to be attached to each other by welding, particularly in the region of the edges. In particular, it is thus possible to produce largely frameless and thus lighter transport containers.

16 Claims, 2 Drawing Sheets

(51) Int. Cl.

| | |
|---|---|
| ***B65D 88/14*** | (2006.01) |
| ***B65D 88/74*** | (2006.01) |
| ***B65D 90/02*** | (2019.01) |
| ***B65D 90/06*** | (2006.01) |
| ***F25D 3/06*** | (2006.01) |

(52) U.S. Cl.
CPC ..... *B65D 88/744* (2013.01); *B65D 90/022* (2013.01); *B65D 90/06* (2013.01); *B65D 90/507* (2019.02); *F25D 3/06* (2013.01); *B65D 2590/0083* (2013.01); *F25D 2201/14* (2013.01); *F25D 2303/08221* (2013.01)

(58) Field of Classification Search
USPC ..... 220/560.12, 560.14, 560.15, 220/592.01–592.28, 739
See application file for complete search history.

(56) References Cited

U.S. PATENT DOCUMENTS 4,084,366 A * 4/1978 Saylor ..... B29D 24/005 52/791.1
4,162,341 A * 7/1979 Norton ..... B29C 44/0407 428/117
4,282,280 A * 8/1981 Cook, Jr. ..... F17C 13/001 220/901
4,625,710 A * 12/1986 Harada ..... F28D 20/02 126/619
4,803,108 A * 2/1989 Leuchten ..... B32B 3/12 428/118
5,180,619 A * 1/1993 Landi ..... A61G 5/1043 428/116
5,230,941 A * 7/1993 Hollander ..... B32B 3/12 428/116
5,923,003 A * 7/1999 Arcas ..... B64C 21/04 181/213
6,061,993 A * 5/2000 Bendixen ..... E04C 2/365 428/117
6,767,606 B2 * 7/2004 Jackson ..... B32B 3/28 156/250
6,971,539 B1 * 12/2005 Abbe ..... B65D 25/205 220/592.12
8,413,761 B2 * 4/2013 Ayle ..... G10K 11/172 181/292
9,248,958 B2 * 2/2016 Pherson ..... B65D 88/14
9,598,221 B2 * 3/2017 Ros ..... B32B 3/02

* cited by examiner

THERMALLY INSULATED TRANSPORT CONTAINER COMPRISING THERMAL INSULATION RESTING AGAINST THE WALLS, AND WALL STRUCTURE OF A CONTAINER OF SAID TYPE

CROSS-REFERENCE TO RELATED APPLICATIONS

This application is a U.S. national counterpart application of international application serial No. PCT/EP2015/074707 filed Oct. 26, 2015, which claims priority to German Patent Application Nos. 102014221657.5 and 102015113693.7, filed Oct. 24, 2014 and Aug. 19, 2015 (respectively).

The invention relates to a thermally insulated transport container with a housing for forming a space for goods, with walls and a thermal insulation abutting the walls as well as a wall structure of such a container. In particular, the invention relates to such a container as an air cargo container.

Articles, food, pharmaceuticals, biological samples, blood, blood plasma or even organs intended for transplantation are stored or transported in a temperature regulated manner in thermally insulated containers, in the respectively suitable form. No adverse effects over an extended period of time are supposed to occur in the process, and no additional energy for additional cooling or heating is to be supplied, particularly in the case of air cargo. Also, these containers are being transported without any supervision over extended periods of time, and are therefore equipped with communication means for data transmission, e.g. GPS, GSM for transmission of position and temperature monitoring, RFID for registration with the logistics company, etc.

For this purpose, containers that have a thermal insulation are being used at present. In the simplest case, such containers are produced from, or also with, polymer foams such as, for example, polystyrene (Styrofoam). Though, advantageously, the foams' own mass is low, they are not very durable and stable. Moreover, the obtainable heat insulation is limited.

The use of vacuum insulation panels (VIP) is known. These panels have an improved heat insulation, but only for as long as the high negative pressure required within the panels can be maintained. The outer shell of vacuum insulation panels is usually formed from at least one film that can also be coated with a metal. However, both the film and, in particular, the connections of the film for the gas-tight seal of the panels, e.g. in the form of sealed seams, are critical, and leakage may occur due to mechanical stress or thermal influence, so that the vacuum conditions inside are lost. Therefore, DE 10 2011 015 715 A1 discloses a wall structure with an inner wall of a thermoplastic polymer for protecting the vacuum insulation panel.

A known vacuum insulating panel consists of a pre-compressed porous filling, a porous pressed plate or an open-cell, hard foam as a substrate encased by a gas-tight film, the film being connected by welding or gluing after evacuation. For example, precipitated and dried silicic acids, silica gels, fly ash, organic-based open-cell foams, such as polyurethane rigid foams or bound polyurethane rigid foam powder as they are described in DE 4 439 331 and DE 4 439 328, serve as filling materials of vacuum insulating panels. Such vacuum insulating panels are also already used in the production of cooling chambers, e.g. refrigerators or refrigeration containers by being inserted between the outer and inner housings and the remaining intermediate space between the outer and inner housing being filled with foam.

For example, EP 0 822 379 discloses a vacuum insulating panel mounted on a rigid plate, which is fixed on the rigid plate by a polyurethane foam applied as a liquid reaction mixture.

Other known containers require a stability-providing frame into which the multi-layered walls, e.g. made of metal sheets with a glued-in insulation, are inserted. The structure is complicated, expensive and has a high weight, which is to be avoided particularly in the case of air cargo.

It is therefore the object of the invention to develop a thermally insulated transport container developed further in comparison with the prior art, or to further develop details.

This object is achieved by a thermally insulated transport container having the features of the main claim. Advantageous embodiments are the subject matter of the dependent claims. Further developments are the subject matter of co-ordinated claims.

First of all, and necessarily, the thermally insulated transport container according to the invention comprises a housing for forming a space for goods, i.e. the articles to be transported and cooled. Furthermore, the housing has walls and a thermal insulation abutting the walls. According to the invention, sandwich plastic plates are provided as walls, with a honeycomb core welded on both sides to one covering ply, respectively, the honeycomb core and the covering plies consisting of a thermoplastic material, preferably PP. In this case, the walls are, in particular, a thermoplastic sandwich panel, consisting substantially of a PP (polypropylene) honeycomb core and PP covering layers, in particular glass-fiber reinforced, which are, with regard to the materials, homogenously connected to each other by thermally fused connection. Such plates are offered, for example, by Wihag Composites GmbH & Co. KG under the trademark MonoPan®, which are preferred in this case.

The use of thermoplastic material makes it possible for adjacent sandwich plastic plates to be attached to each other by welding. In particular, they can be welded to each other in the region of the edges and corners of the housings, and thus form the latter. In particular, it is thus possible to produce largely frameless and thus lighter transport containers. A reinforcement, which absorbs the load of the door in particular, may optionally be provided only in the region of the door. In principle, an outer corner, inner corner, outer edge and/or inner edge protection means may also be provided, which constitutes more of a mechanical protection means of the sensitive edges/corners, and may optionally also serve as a base, guide or support surface for better placement and/or stacking of the containers. The protection means may also serve the purpose of providing a seal against the air or heat insulation, because the insulating honeycomb structure is affected in the region of the welding seam. Usually aluminum sheets or light-weight aluminum construction plates are inserted into a stability-providing frame consisting of aluminum profiles. Frequently, these connections are not tight, which enables an unwanted heat transfer by means of the exchange of air. Sandwich plastic plates of thermoplastic material that are welded together enable a seal without any additional sealing mass and working steps. Moreover, thermoplastic plastics have a lower density and thermal conductivity and are transmissive with regard to radio waves. Preferably, welding is in this case carried out by means of fusion welding, heated-air welding or plastic extrusion welding. Such plates can also be easily cut to size.

Preferably, the transport container has a frameless construction, with the sandwich plastic plates that are connected to each other forming a torsion-resistant, self-supporting housing. Thus, no auxiliary frame, e.g. made from aluminum profiles, is required. Preferably, no further stiffening elements in addition to the sandwich plastic plates and/or a door reinforcing means for a door and/or the corner or edge protection means are therefore provided.

If vacuum insulating panels are provided as thermal insulation, light, industrially produced components can be used that have an excellent heat insulation.

Preferably, the walls have two plies of the sandwich plastic plates with an, in particular abutting, thermal insulation located therebetween. Thus, the thermal insulation, in particular the sensitive vacuum insulating panels, are protected on both sides against damage and the wall is stiffened by the abutting thermal insulation.

If in this case a preferably self-supporting outer housing of welded-together sandwich plastic plates and a preferably also self-supporting inner housing of welded-together sandwich plastic plate is provided, the inner housing forming the space for goods and being disposed in the outer housing at a distance from the outer housing, the space between the inner and outer housings being filled with the thermal insulation, the inner housing can be removed as a connected whole or plate by plate for maintenance and/or cleaning purposes. In particular if using vacuum insulating panels, it is important that they are easy to access and exchange or examine.

If in this case, the insulation is also preferably fastened in the outer housing in a two-dimensional manner or in portions or in a point-shaped manner, and if further the inner housing is preferably inserted into the insulation, this results in a further stiffening by the combination of the components.

If the sandwich plastic plates consist exclusively of thermoplastic material, preferably PP, the weldability is simplified and the welding seams are improved, particularly their tightness and stability.

Alternatively, it is preferred that the one or both covering plies and/or the honeycomb core are fiber reinforced, in particular glass or carbon fiber reinforced and/or have such a covering and/or intermediate ply. With only a small adverse effect on the weldability, the stability of the walls is considerably increased, with only a minimal weight increase of the container.

Preferably, the honeycomb core, with regard to the materials, is homogeneously connected to the cover layers by means of thermally fused connection.

The suitability of the container for maintaining the prescribed temperature during longer transport, e.g. as air cargo, is given, in particular, if the thermal conductivity of the thermal insulation is 0.002-0.009 W/m K.

For monitoring the route and the transport conditions of the container according to the invention during transport, communication means, in particular mobile transceivers, RFID or other wireless transmitters/receivers are preferably provided within the outer housing for data transmission. Due to the short range, RFID serve for registration with the logistics company. For example, these communication means can be disposed outside the thermal insulation but within the outer housing, or simply inside the container. Therefore, passages e.g. to the antenna or sensors through the wall are omitted. Preferably, the communication means comprise integrated sensors or are connected or connectable with them. Therefore, the communication means can be replaced and maintained in their entirety, if need be, without a complex wiring being required, which can therefore also not be inadvertently forgotten. The communication means can simply be incorporated into the transport containers that are in use, so that no communication means have to be kept in store for containers not in use.

In particular, GPS for transmission of position and sensors for temperature monitoring are considered integrated sensors or sensors that are connected or connectable to the communication means. Vacuum detectors for monitoring the air pressure in the vacuum insulating panels may also be provided as sensors.

If the door reinforcing means preferably comprises a profile, in particular a frame formed therefrom, consisting of a light metal alloy, in particular aluminum, which is attached to the outer housing and the inner housing and connects them with one another, this results in an increased stability in the region of the opening for the door. Thus, the door reinforcing means forms a door frame for inserting and accommodating the door and connects the inner housing with the outer housing and seals it off. The frame stiffens the PP housing, which is normally relatively soft in the region of the door opening, in such a way that opening the heavy door does not cause any twisting of the housing due to the introduction of the load of the door into the hinge attached to the wall and/or that the door may possibly hang in the housing frame in a slightly skewed manner. The door reinforcing means permits a weaker design of the walls and thus saves weight. If need be, it also serves for attaching the door, e.g. by means of the hinges or a locking mechanism.

Even if cooling of the container according to the invention is realized in any usual manner, e.g. by means of a refrigerating machine, cold storage devices or the storing effect of the goods located therein, the use of cold storage devices 7 is preferred, in particular of latent-heat storage devices. A latent-heat storage device is a device that is capable of storing thermal energy in a hidden manner, with little loss, over many repeated cycles and a long period of time. For this purpose, so-called phase change materials (PCM) are used, whose latent heat of fusion, heat of solution or heat of absorption is considerably greater than the heat that they are capable of storing due to the normal specific heat capacity (without the phase transition effect).

Preferably, paraffin-filled storage elements are used as PCMs, e.g. a PCM that is supposed to maintain the temperature in the container in the range of 2-8° C. has a melting point of 4° C. PCMs serve as buffers against unwanted cooling-off and heating-up. The latent-heat storage devices are removably attached in the space for the goods, e.g. in brackets in the form of rails 71. The used-up storage devices can thus be replaced with the regenerated ones.

Preferably, the space for the goods is designed and dimensioned in such a way that international standard pallets (US, Asia, Europe) can be inserted and strapped into it.

Independently from the configuration of the transport box, protection is also generally sought for the wall structure of a thermally insulated transport container, with a thermal insulation inserted between two walls, which is characterized in that sandwich plastic plates are provided as walls, with a honeycomb core welded on both sides to one covering ply, respectively, the honeycomb core and the covering plies consisting of a thermoplastic material, preferably PP, wherein, preferably

- vacuum insulating panels are provided as thermal insulation;
- the sandwich plastic plates consist exclusively of thermoplastic material, preferably PP;
- the one or both covering plies and/or the honeycomb core are fiber reinforced, in particular glass or carbon fiber reinforced and/or have such a covering and/or intermediate ply;

the honeycomb core, with regard to the materials, is homogeneously connected to the cover layers by means of thermally fused connection; and/or the thermal conductivity of the thermal insulation is 0.002-0.009 W/m K.

In connection with the above configuration of the transport box, but also generally, it is claimed, with regard to a transport box with walls and several vacuum insulating panels abutting the walls as thermal insulation, that the vacuum insulating panels each have a vacuum detector for monitoring the air pressure in the respective vacuum insulating panel, wherein each vacuum detector has a digital circuit with its own address that can be read out via a data bus;

all vacuum detectors are connected to a data bus; and a read-out unit is connected to the data bus in such a way that the air pressure can be retrieved by all vacuum detectors continuously or upon user request. This enables the monitoring of the sensitive vacuum insulating panels for leakage without them having to be removed and examined with a lot of effort. Due to the many vacuum insulating panels incorporated into a transport box, a direct wire connection of each individual detector to the read-out unit would require too much effort. Therefore, a data bus connects all vacuum insulating panels in a simple manner. Electric connectors can be provided on each vacuum insulating panel or detector for replacement. The read-out unit may also be a component of the communication means described above. The read-out unit indicates which vacuum insulating panels are defective and require replacement. Preferably, the read-out unit is configured in such a way that it can only be read out by authorized persons, e.g. by means of a key, a device that can be connected to the read-out device, be it via cable or wirelessly, e.g. by radio or IR.

Preferably, a strain gauge applied to the vacuum insulating panel is provided as a vacuum detector for monitoring the air pressure in the respective vacuum insulating panel. As the air pressure in the vacuum insulating panel rises, the encasing sheet changes, which is registered by the strain gauge applied/glued to the film as a change in resistance. A special transponder, which includes both the bridge circuit/amplifier and a storage unit and a transmitting/receiving antenna, can also be applied directly to the sensor. The supply voltage for the bridge circuit and control signals can now be transmitted from the outside by means of a transmitting/receiving unit, and corresponding measurement signals are received via the same way. This configuration is described, for example, in DE 101 59 518.

In connection with the above configuration of the transport box, but also generally, it is recognized and claimed, in a transport box with walls or doors, that the sandwich plastic plates with their honeycomb core can also serve as a bearing for pivotable members. For this purpose, cylindrical recesses are provided in the honeycomb core which extend in the plane of the honeycomb core, preferably over the entire length of the honeycomb core, wherein fastening, pivoting or locking members are rotatably inserted into the recesses. It is thus possible to place hinges, axes or door locking mechanisms into the wall. Normally it is necessary to mount corresponding bearings for axes on the wall, which requires construction space and weight. Even though the light honeycomb core appears to have little stability at first sight, it is nevertheless sufficiently firm if an axis extends over a greater length or the entire length of the honeycomb core or of the wall/door. In this case, the honeycomb core can directly form the bearing for the pivotable member located therein, or the bearing is formed by a thin-walled sleeve inserted into the honeycomb core.

Preferably, the container has the following dimensions, particularly if used as an air cargo transport container.

Height: 1,300-1,600 mm;

Width 800-2,000 mm;

Depth 1,400-1,800 mm;

Thickness of the sandwich plastic plate (inner housing) 10-20 mm;

Thickness of the sandwich plastic plate (outer housing) 10-50 mm;

Distance between the inner and the outer housing: 25-80 mm; and/or

Thermal conductivity of the thermal insulation: 0.002-0.009 W/mK.

These dimensions permit international standard pallets (US Asia, Europe) to be capable of being accommodated in the transport container.

If the thickness of the sandwich plastic plate of the inner housing is smaller than the thickness of the sandwich plastic plate of the outer housing, weight is saved because the requirements with respect to stability of the outer housing are higher.

Further advantages become apparent from the following description and the attached Figures. Also, the features mentioned above and explained in more detail below can each be used individually or in any combinations according to the invention. The embodiments mentioned shall not be understood to be final and have the character of examples.

FIG. 1 shows a thermally insulated transport container 1 according to the invention, which is closed with a door 5, in an embodiment as an air cargo refrigerating container. The self-supporting outer housing 1*a* is formed by walls 3*a* made of sandwich plastic plates with a honeycomb core welded on both sides to one covering ply, respectively, the honeycomb core and the covering plies consisting of the thermoplastic material PP. The structure of the sandwich plastic plates is not shown in more detail in the Figures. Adjacent sandwich plastic plates 3*a* are attached to each other by welding and sealed along their joint edge 32 and/or across the corner 31. The container is closed with a door 5.

Figure 2:
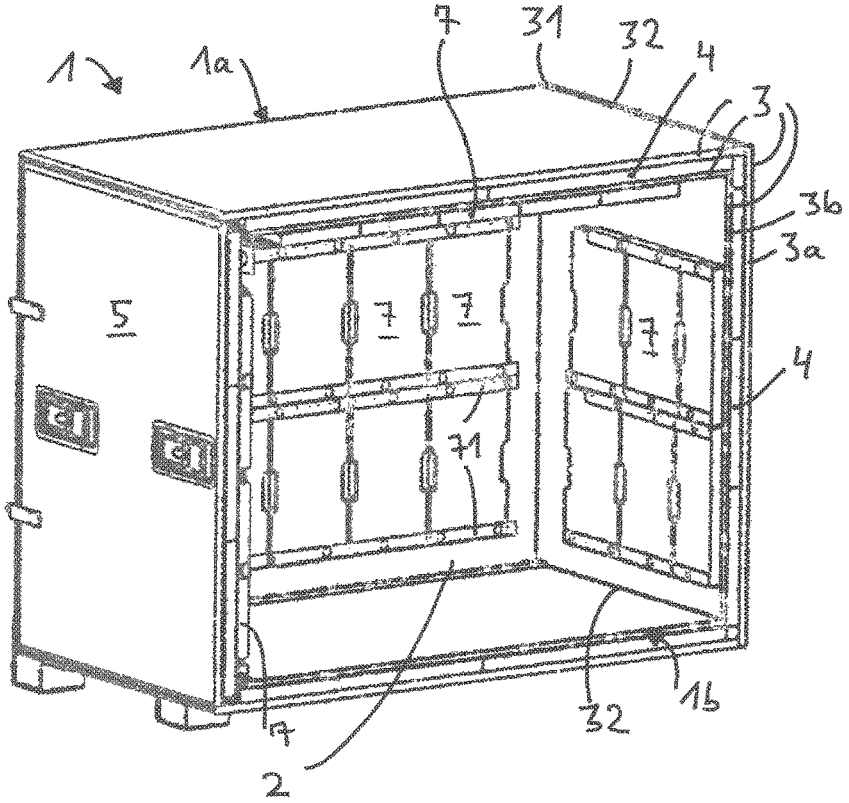

FIG. 2 shows the container from FIG. 1 in a section through the door 5 and the housing 1*a*, 1*b*. The thermally insulated 1 has a double-walled housing 1*a*, 1*b* for forming a space 2 for goods. The self-supporting outer housing 1*a* consists of sandwich plastic plates 3*a* welded together along their joint edge 32 or corner 31. The self-supporting inner housing 1*b*, which is formed in the same manner and consists of sandwich plastic plates 3*b* welded together along their joint edge 32 or corner 31, is located therein. In this case, the inner housing 1*b* forms the space 2 for goods and is disposed at a distance from the outer housing 1*a* in the outer housing. The space between the inner and outer housings is filled with the thermal insulation 4, in this case numerous vacuum insulating panels (VIP). The vacuum insulating panels 4 are fastened in the outer housing 1*a*. The inner housing 1*b* is inserted into the vacuum insulating panels 4.

Thus, the walls 3 substantially consist of two plies of the sandwich plastic plates 3*a*, 3*b* with an abutting thermal insulation 4 of VIP located therebetween.

As cold storage devices, the space 2 contains numerous latent-heat storage devices 7 which are inserted in a removable manner into brackets in the form of rails 71. These are standard products, which are therefore available in numerous variations and inexpensively.

Figure 3:
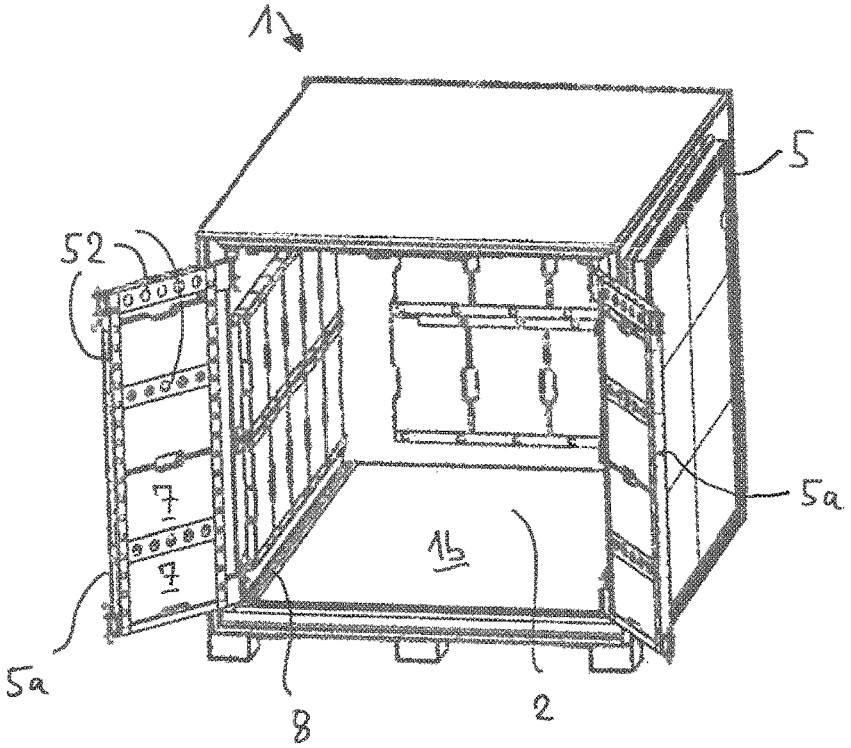

FIG. 3 shows the container 1 with a door 5 opened by 270°. Inner doors consist 5*a* of struts 52 which in part serve as rails for inserting the latent-heat storage devices 7. Thereby, they are uncoupled from the heat-insulating door 5, which is therefore particularly light and requires only a weak joint.

Airline rails 8 on the bottom of the space formed by the inner housing 1*b* permit a secure attachment of goods placed in standard containers in the space 2.

Figure 4:
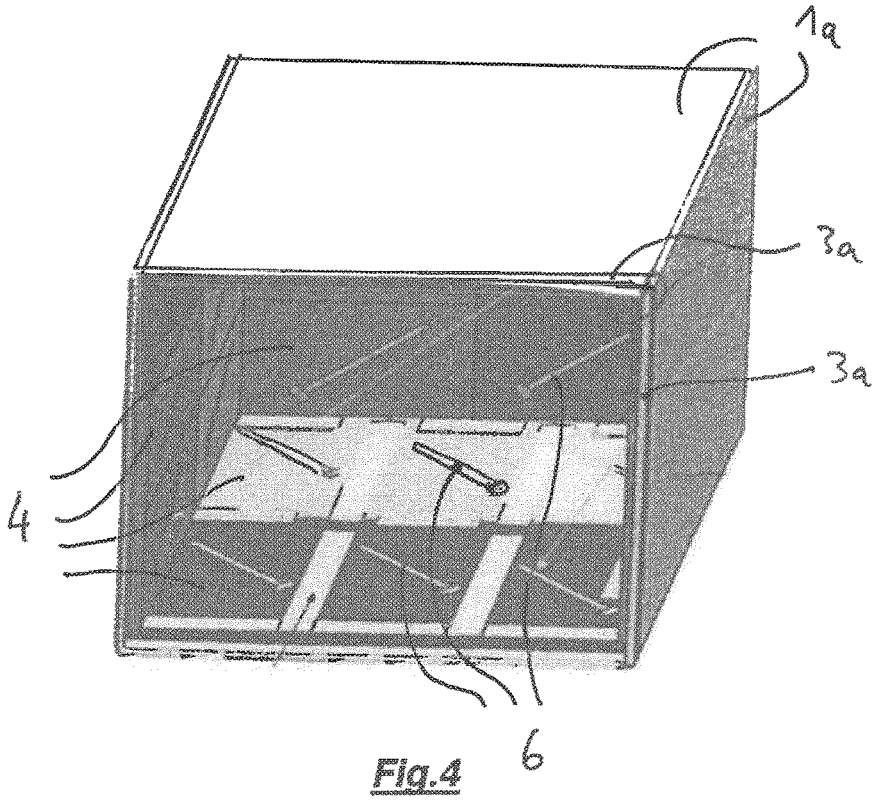

FIG. 4 shows the outer housing with vacuum panels 4 mounted therein, which are visible due to the inner housing 1*b* not being inserted. On their outer walls, the vacuum insulating panels 4 each carry a vacuum detector, in this case in the form of a strain gauge 6 for monitoring the air pressure in the respective vacuum insulating panel. What is not shown here is that each vacuum detector has a digital circuit with its own address that can be read out via a data bus and that all vacuum detectors are connected to a data bus, and that a read-out unit is connected to the data bus in such a way that the air pressure can be retrieved by all vacuum detectors continuously or upon user request.

The invention claimed is:

1. A thermally insulated transport container with a housing for forming a space for goods, the container comprising walls and a thermal insulation including a honeycomb core abutting the walls, wherein sandwich plastic plates are provided as walls, with the honeycomb core welded on both sides to one covering ply, respectively, the honeycomb core and the covering plies consisting of a thermoplastic material, wherein the sandwich plastic plates that are connected to each other form a self-supporting housing, wherein no further stiffening elements in addition to the sandwich plastic plates and the thermal insulation and a door reinforcement for a door are provided to form the self-supporting housing of the container.

2. The container according to claim 1, wherein adjacent sandwich plastic plates, along their joint edges and across a corner, are attached to each other by welding and sealed.

3. The container according to claim 1, wherein vacuum insulating panels are provided as thermal insulation.

4. The container according to claim 1, wherein the walls have two plies of the sandwich plastic plates with abutting thermal insulation located therebetween, and wherein a self-supporting outer housing of welded-together sandwich plastic plates and a self-supporting inner housing of welded-together sandwich plastic plates is provided, the inner housing forming the space for goods and being disposed in the outer housing at a distance from the outer housing, the space between the inner and the outer housing being filled with the thermal insulation, the insulation further being fastened in the outer housing in a two-dimensional manner or in portions or in a point-shaped manner, and the inner housing further being inserted into the insulation.

5. The container according to claim 1, wherein the sandwich plastic plates consist exclusively of thermoplastic material.

6. The container according claim 1, wherein the one or both covering plies and the honeycomb core are fiber reinforced and wherein the honeycomb core, with regard to the materials, is homogeneously connected to the covering plies by a thermally fused connection.

7. The container according claim 1, wherein a thermal conductivity of the thermal insulation is 0.002-0.009 W/m K.

8. The container according to claim 1, wherein communication means for data transmission are provided within an outer housing, which include integrated sensors or are connected or connectable with them, wherein, furthermore, GPS for transmission of position, sensors for temperature monitoring and vacuum detectors for monitoring an air pressure are provided as sensors in the vacuum insulating panels.

9. The container according to claim 1, wherein the door reinforcing means comprises a profile consisting of a light metal alloy, which is attached to an outer housing and an inner housing and connects them with one another.

10. A wall structure of a thermally insulated transport container, the wall structure comprising a thermal insulation inserted between two walls, wherein sandwich plastic plates are provided as walls, with a honeycomb core and a weld between one side of the honeycomb core and one covering ply, and a weld between another side of the honeycomb core and another covering ply, the honeycomb core and the covering plies consisting of a thermoplastic material, wherein cylindrical recesses are provided in the honeycomb core which extend in a plane of the honeycomb core, over an entire length of the honeycomb core, wherein fastening, pivoting or locking members are rotatably inserted into the recesses.

11. The wall structure according to claim 10, wherein vacuum insulating panels are provided as thermal insulation.

12. The wall structure according to claim 10, wherein the sandwich plastic plates consist exclusively of thermoplastic material.

13. The wall structure according to claim 10, wherein the one or both covering plies and the honeycomb core are glass or carbon fiber reinforced.

14. The wall structure according to claim 10, wherein the honeycomb core-is materially homogeneously connected to the covering plies by means of thermally fused connection.

15. The wall structure according to claim 10, wherein the thermal conductivity of the thermal insulation is 0.002-0.009 W/m K.

16. A thermally insulated transport container, with a housing for forming a space for goods, the container comprising walls and several vacuum insulating panels abutting the walls as thermal insulation, wherein the vacuum insulating panels each have a vacuum detector for monitoring an air pressure in the respective vacuum insulating panel, wherein each vacuum detector has a digital circuit with its own address that can be read out via a data bus; wherein all vacuum detectors are connected to a data bus; and wherein a read-out unit is connected to the data bus in such a way that the air pressure can be retrieved by all vacuum detectors continuously or upon user request.

* * * * *